United States Patent [19]

Williams et al.

[11] 4,266,522

[45] May 12, 1981

[54] FUEL INJECTION SYSTEMS

[75] Inventors: Malcolm Williams, Solihull; Albert R. Tingey, Whitacre Heath; John P. Southgate, Braunton Nr. Barnstable; Steven J. Russell, Coventry, all of England

[73] Assignee: Lucas Industries Limited, Birmingham, England

[21] Appl. No.: 30,683

[22] Filed: Apr. 16, 1979

Related U.S. Application Data

[63] Continuation of Ser. No. 847,625, Nov. 1, 1977, abandoned.

[30] Foreign Application Priority Data

Nov. 4, 1976 [GB] United Kingdom ..... 45860/76

[51] Int. Cl.[3] ..... F02D 5/02

[52] U.S. Cl. ..... 123/492; 123/493

[58] Field of Search ..... 123/32 EA, 32 EH, 32 EL, 123/32 ED

[56] References Cited

U.S. PATENT DOCUMENTS

| | | | |
|---|---|---|---|
| 3,661,126 | 5/1972 | Baxendale | 123/32 EH |
| 3,673,989 | 7/1972 | Aono et al. | 123/32 EH |
| 3,908,614 | 9/1975 | Ironside et al. | 123/32 ED |
| 3,946,704 | 3/1976 | Monpetit | 123/32 EA |
| 3,983,851 | 10/1976 | Hoshi | 123/32 EA |
| 4,010,717 | 3/1977 | Taplin | 123/32 EH |

FOREIGN PATENT DOCUMENTS

| | | | |
|---|---|---|---|
| 2241694 | 3/1975 | France | 123/32 EH |

*Primary Examiner*—Charles J. Myhre
*Assistant Examiner*—Andrew M. Dolinar
*Attorney, Agent, or Firm*—Ladas & Parry

[57] ABSTRACT

An electronic fuel injection control includes a main fuel control circuit which operates to control fuel flow to the engine by controlling the duration of engine-synchronized fuel valve opening pulses in accordance with at least one engine parameter. An auxiliary pulse source is arranged to provide extra unsynchronized pulses to improve the acceleration characteristics of the control, such pulses being produced when the throttle is opened. A muting circuit is provided which operates for a fixed period following closing movement of the throttle, to prevent the auxiliary pulse source responding to throttle opening during said period. The muting circuit prevents excess fuelling during gear changes etc.

6 Claims, 10 Drawing Figures

FUEL INJECTION SYSTEMS

This is a continuation of application Ser. No. 847,625 filed Nov. 1, 1977, now abandoned.

This invention relates to an electronic fuel injection control for an internal combustional engine.

An electronic fuel injection control in accordance with the invention comprises a main fuel control circuit for applying to at least one fuel injection valve pulses of duration determined by at least one engine operating parameter controlling said main fuel control circuit, an auxiliary pulse source sensitive to opening movement of the engine throttle for applying at least one additional pulse to said fuel injection valve when the throttle is opening, and muting means sensitive to closing movement of the throttle and arranged to prevent the auxiliary pulse source from producing a pulse for a predetermined time following closing movement of the throttle.

The auxiliary pulse source may be responsive to the rate of change of the position of the throttle so as to produce a pulse whenever the rate of change exceeds a predetermined positive value. In that case the muting means may be arranged to be brought into operation when the rate of change is less than a predetermined negative value.

Alternatively the auxiliary pulse source may be arranged to be actuated during throttle opening movement at specific throttle positions, muting occurring following throttle closing movement through associated specific throttle positions.

In the accompanying drawings

Figure 1:
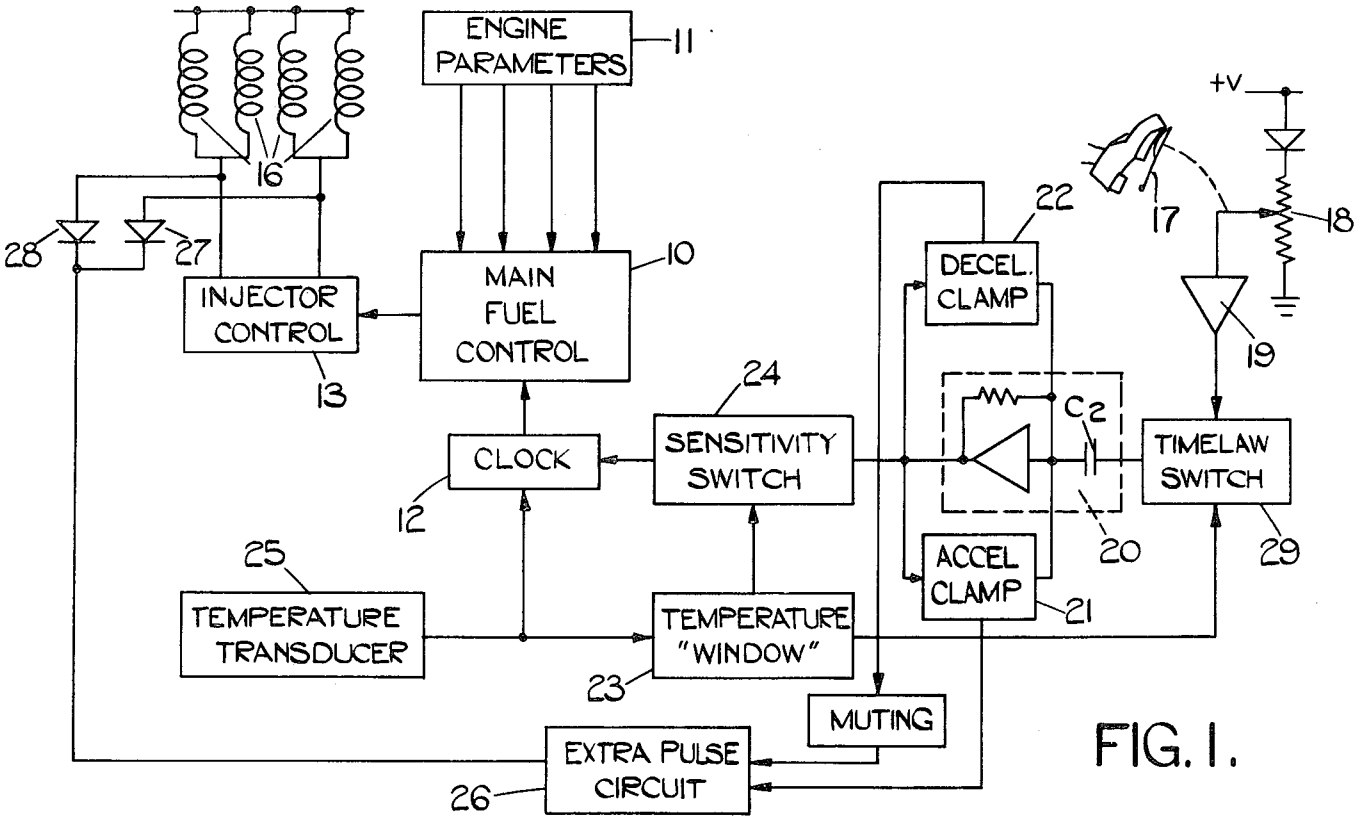
FIG. 1 is a schematic diagram illustrating one example of an electronic fuel injection control in accordance with the invention.

Referring firstly to FIG. 1 the overall system comprises a main digital fuel control 10 of known type utilizing digital computation techniques to produce a digital fuel demand signal in accordance with the value or values of one or more engine operating parameters selected from air intake mass flow, engine speed, air intake manifold pressure, air intake throttle position. Such parameter or parameters is or are measured by one or more transducers 11. The digital fuel demand signal is generated by means of a read only memory matrix incorporated in the control 10 which produces a multi-bit digital output signal in accordance with the value or values of digital signals addressing the matrix and derived from the transducer or transducers. The multi-bit digital signal may be used in either of two equivalent ways. Firstly, it may be transferred to a presettable counter which is then clocked to zero or it may be applied, if need be via a latch, to one input of a digital comparator whilst the output of a counter being clocked up from zero is applied to the other input of the comparator. In either case the digital signal is transformed to a pulse duration directly proportional to the digital signal and inversely proportional to the clock frequency. FIG. 1 shows a clock pulse-generator 12 which provides the clock pulses and a fuel injector control 13 which receives the pulse duration modulated signals from the main fuel control 10.

The control 13 has two output terminals to which the pulse modulated signals from the control 10 are alternately steered, each output stage of the control 13 including an open collector power transistor (not shown). These output stages are connected to two groups of solenoids 16 forming part of a bank of fuel injection valves.

FIG. 1 illustrates a number of arrangements by means of which the clock pulse frequency is varied, both as a function of engine water temperature and as a function of the rate of movement of an accelerator pedal 17. The pedal 17 is linked to the slider of a potentiometer 18, which slider is connected by a buffer input stage 19 to an operational amplifier differentiating circuit 20, via a capacitor $C_2$ (which forms a part of the differentiating circuit). The circuit has clamping feedback circuits 21 and 22 which operate respectively in acceleration and deceleration. A water temperature "window" circuit 23 which controls a sensitivity switch 24 through the intermediary of which the output of the differentiating circuit 20 is applied to the clock 12 and also controls a time law circuit 29 at the input to the differentiating circuit 20. The "window" circuit 23 receives an input from a temperature transducer circuit 25, which also provides an input to the clock 12.

FIG. 1 also shows an "extra pulse" circuit 26 which is triggered by the acceleration clamping circuit 21, but which is muted for a predetermined time after a deceleration has been demanded by an input from the deceleration clamping circuit 22. The circuit 26 has an open collector output stage connected by parallel diodes 27, 28 to the solenoids 16 as will be explained in more detail hereinafter.

Figure 2:
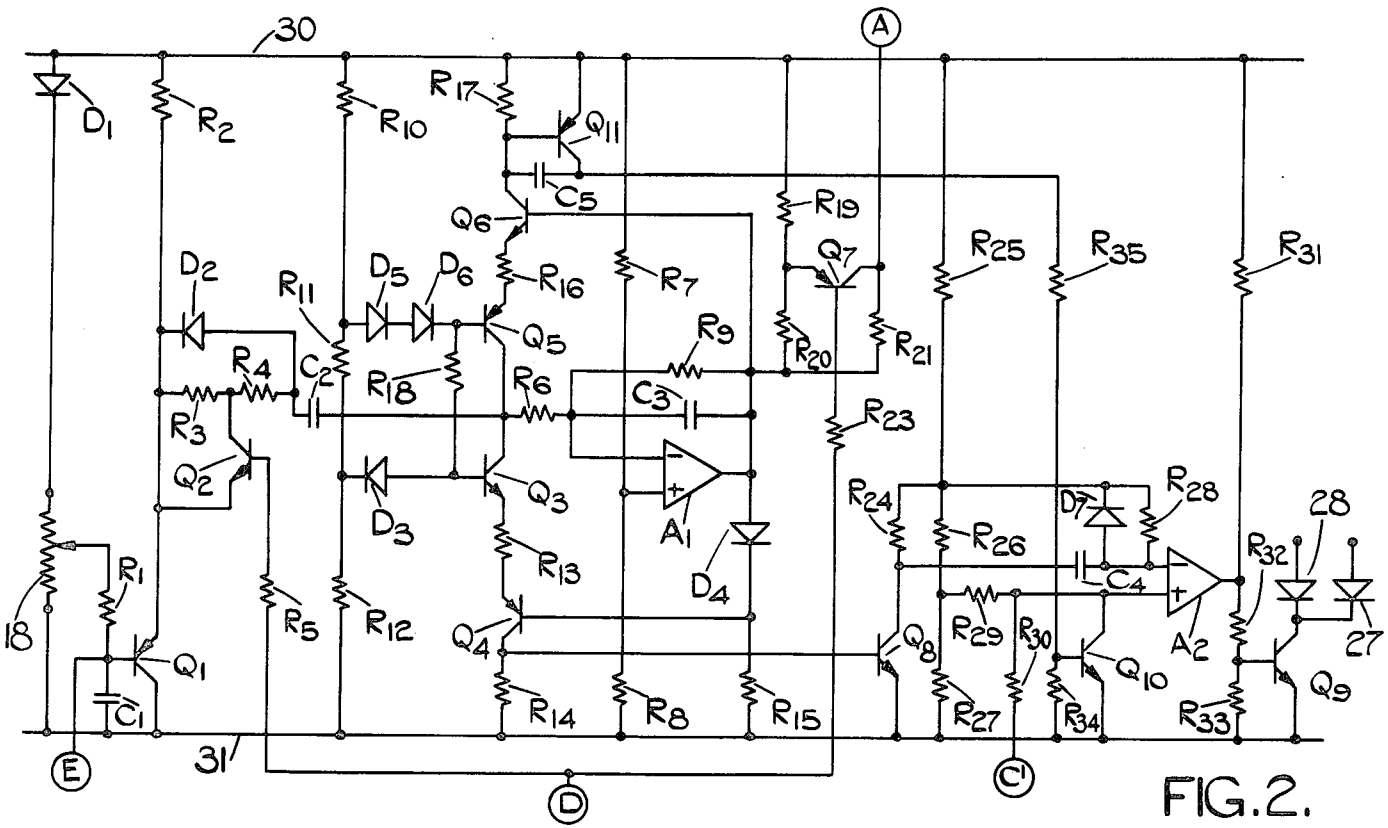
FIG. 2 is a circuit diagram of a part of the control shown in FIG. 1.

Turning now to FIG. 2 the potentiometer 18 is connected in series with a diode $D_1$ between a regulated voltage supply rail 30 and an earth rail 31. The slider of the potentiometer 18 is connected via a resistor $R_1$ and a capacitor $C_1$ in series to the rail 31. The common point of the resistor $R_1$ and capacitor $C_1$ at which there appears a filtered d.c. signal corresponding to the position of the slider of the potentiometer 18 is connected both to a terminal E (see also FIG. 4) and to the base of a pnp transistor $Q_1$ connected as an emitter follower buffer with its collector grounded to rail 31 and its emitter connected by a resistor $R_2$ to the rail 30.

The emitter of the transistor is connected by a time-law switch circuit to one side of a capacitor $C_2$ which forms the input of the differentiating circuit 20. The time law switching circuit comprises two resistors $R_3$, $R_4$ is series between the emitter of the transistor $Q_1$ and the capacitor $C_2$ with the resistor $R_3$ of larger ohmic value bridged by the collector-emitter of an npn transistor $Q_2$ which has its base connected by a resistor $R_5$ to a terminal D, (see also FIG. 3). A diode $D_2$ has its anode connected to the common point of the resistor $R_4$ and the capacitor $C_2$ and its cathode connected to the emitter of the transistor $Q_1$.

The other side of the capacitor $C_2$ is connected by a resistor $R_6$ to the inverting input terminal of an operational amplifier $A_1$, the non-inverting input terminal of which is connected to the common point of two resistors $R_7$, $R_8$ connected in series between the rails 30, 31. Feedback around the amplifier $A_1$ is provided by the parallel combination of a resistor $R_9$ and a capacitor $C_3$. The main differentiating action of the amplifier is provided the capacitor $C_2$ and the resistor $R_9$ which dominate the transfer function of the amplifier for low frequency signals. The resistors $R_6$ and capacitor $C_3$ provide an integral action at high frequency to overcome the differential action so that the transfer function at high frequencies is integral rather than differential. This eliminates or at least substantially reduces the effect of high frequency noise and interference on the differentiating circuit.

The acceleration and deceleration clamping circuits share a common biasing chain $R_{10}$, $R_{11}$ and $R_{12}$ connected in series between the rails 30, 31. The common point of the resistors $R_{11}$ and $R_{12}$ is connected to the cathode of a diode $D_3$ with its anode connected to the base of an npn transistor $Q_3$ which has its collector connected to said other side of the capacitor $C_2$ and its emitter connected by a resistor $R_{13}$ to the emitter of pnp transistor $Q_4$ having its collector connected to the rail 31 by a resistor $R_{14}$. The base of the transistor $Q_4$ is connected by a resistor $R_{15}$ to the rail 31 and is also connected to the cathode of a diode $D_4$ which has its anode connected to the output terminal of the amplifier $A_1$.

The common point of the resistors $R_{10}$ and $R_{11}$ is connected by two diodes $D_5$, $D_6$ in series to the base of a pnp transistor $Q_5$, the collector of which is connected to said other side of the capacitor $C_2$. The emitter of the transistor $Q_5$ is connected by a resistor $R_{16}$ to the emitter of an npn transistor $Q_6$ the collector of which is connected by a resistor $R_{17}$ to the rail 30. The base of the transistor $Q_6$ is connected directly to the output terminal of the amplifier $A_1$.

The bases of the transistors $Q_3$, $Q_5$ are interconnected by a resistor $R_{18}$.

In steady state conditions the output terminal of the amplifier $A_1$ will be at at voltage set by the resistors $R_7$ and $R_8$. This will set the voltage at the base of the transistor $Q_4$ higher than the voltage at the base of the transistor $Q_3$ so that neither of these will conduct and similarly the transistors $Q_5$, $Q_6$ will be off.

During acceleration the output of the amplifier $A_1$ falls to a level determined by the rate of increase of the voltage at the slider of the potentiometer 18. Should this output voltage fall to a level lower than that at the junction fo the resistors $R_{11}$ and $R_{12}$, the transistors $Q_3$ and $Q_4$ will both turn on, diverting sufficient current from the capacitor $C_2$ to hold the amplifier output constant. When the increase in input voltage ceases capacitor $C_2$ can charge through the resistor $R_4$ and the transistor $Q_2$ (assuming this to be conductive) and the amplifier output returns to its previous voltage at a rate determined by such charging. If the transistor $Q_2$ is not conductive, the inclusion of the resistor $R_3$ is the charge path of the capacitor $C_2$ so as to delay the release of clamping and also increase the duration of charging.

In deceleration, the output of the amplifier $A_1$ increases and eventually turns on transistors $Q_5$ and $Q_6$ to provide the clamping action, when the voltage at the base of transistor $Q_1$ ceases to fall the capacitor $C_2$ discharges rapidly via the diode $D_2$ irrespectively of whether the transistor $Q_2$ is conductive or not.

The diodes $D_3$ and $D_4$ are included to compensate for the base-emitter voltages of the transistors $Q_3$ and $Q_4$ so that no temperature drift effects occur. Similarly the base-emitter voltages of the transistors $Q_5$ and $Q_6$ are compensated for by the diodes $D_5$ and $D_6$.

The output terminal of the amplifier $A_1$ is connected to the rail 30 by two resistors $R_{19}$, $R_{20}$ in series and to an output terminal A by a resistor $R_{21}$, pnp transistor $Q_7$ has its emitter connected to the common point of the resistors $R_{19}$ and $R_{20}$, its collector connected to the terminal A and its base connected by a resistor $R_{23}$ to the terminal D. The transistor $Q_7$ constitutes the sensitivity switch 24 of FIG. 1. As will be explained hereinafter the terminal A is held at a fixed voltage such that the amplifier $A_1$ draws current from terminal A via the resistor $R_{21}$. When transistor $Q_7$ is on the resistors $R_{19}$, $R_{20}$ are arranged to draw no current from terminal A when the signal output is steady, but the overall gain of the circuit is increased—i.e. the current drawn by the amplifier $A_1$ from the terminal A increases for a given rate of increase of the input signal from the accelerator pedal potentiometer 18.

FIG. 2 also shows the extra pulse circuit 26. This is constituted by a transistor $Q_8$ with its emitter grounded to the rail 31 and its collector connected by two resistors $R_{24}$, $R_{25}$ in series to the rail 30. The junction of the resistor $R_{24}$, $R_{25}$ is connected by two resistors $R_{26}$, $R_{27}$ in series to the rail 31 and by a resistor $R_{28}$ to the inverting input terminal of a voltage comparator $A_2$, a diode $D_7$ bridging the resistor $R_{28}$ and a capacitor $C_4$ connecting the collector of the transistor $Q_8$ to the inverting input terminal of the comparator $A_2$. The non-inverting input terminal of the comparator $A_2$ is connected by a resistor $R_{29}$ to the junction of the resistors $R_{26}$, $R_{27}$. The non-inverting input terminal is also connected by a resistor $R_{30}$ to a terminal C' (see FIG. 3). The output terminal of the comparator $A_2$ is connected by a resistor $R_{31}$ to the rail 30 and by two resistors $R_{32}$, $R_{33}$ in series to the rail 31. The common point of the resistors $R_{32}$, $R_{33}$ is connected to the base of a transistor $Q_9$, the emitter of which is grounded to the rail 31 and the collector of which is connected to the cathodes of the diodes 27, 28.

When the transistor $Q_4$ turns on as the acceleration clamping level is reached current flows in resistor $R_{14}$ flows until at some point the transistor $Q_8$ turns on. This reduces the voltage at the junction of the resistor $R_{24}$ and the capacitor $C_4$. Initially, however, capacitor $C_4$ draws current through the resistor $R_{28}$ and thus causes the output of the comparator $A_2$ to go high until the capacitor $C_4$ is charged to a given level. The transistor $Q_9$ conducts for the duration of this pulse, causing an additional injection action from all the injectors simultaneously. When the transistors $Q_4$ and $Q_8$ turn off again the diode $D_7$ allows rapid discharge of the capacitor $C_4$, and limits the voltage excursion of the inverting input terminal of the comparator $A_2$.

For muting the extra pulse circuit just described an npn transistor $Q_{10}$ has its emitter connected to the rail 31 and its collector connected to the non-inverting input terminal of the comparator $A_2$. The base of the transistor $Q_{10}$ is connected to the common point of two resistors $R_{34}$ and $R_{35}$ connected in series between the rail 31 and the collector of a pnp transistor $Q_{11}$. The base of $Q_{11}$ is connected to the collector of the transistor $Q_6$ and its emitter is connected to the rail 30. A capacitor $C_5$ is connected between the base and collector of the transistor $Q_{11}$.

When the transistor $Q_6$ turns on as the deceleration clamping level is reached, the transistor $Q_{11}$ turns on at a predetermined higher level set by the resistor $R_{17}$ thereby turning on transistor $Q_{10}$ and grounding the non-inverting input terminal of the comparator $A_2$. The transistor $Q_{11}$ does not turn off immediately the transistor $Q_6$ turns off because the capacitor $C_5$ continues to supply base current to the transistor $Q_{11}$ for a predetermined period, thereby preventing operation of the extra pulse circuit for a predetermined time after a "clamping level" deceleration has taken place. This muting arrangement comes into play when rapid pedal movements are executed such as during gear changing or during repeated acceleration of an unloaded engine prior to pulling away from rest.

Figure 3:
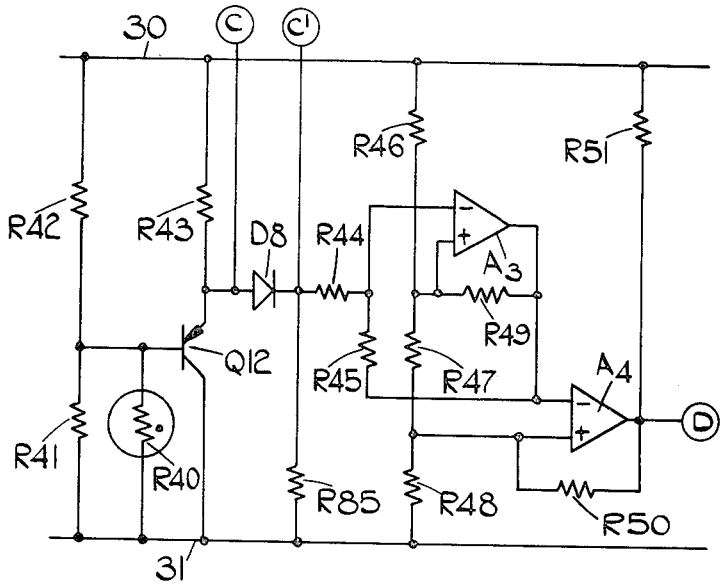
FIG. 3 is the circuit diagram of a temperature transducer circuit and a temperature "window" circuit forming part of the control of FIG. 1.

The temperature dependent circuit of FIG. 3 includes a thermistor $R_{40}$ sensitive to the engine cooling water temperature. The thermistor $R_{40}$ is connected between the base of a pnp transistor $Q_{12}$ and the rail 31 in parallel with a resistor $R_{41}$, a resistor $R_{42}$ being connected between such base and the rail 30. The collector of the transistor $Q_{12}$ is connected to the rail 31 and its emitter is connected by a resistor $R_{43}$ to the rail 30 and is also connected to a terminal C and to the anode of a diode $D_8$ with its cathode connected by a resistor $R_{85}$ to the rail 31 and also connected to the terminal C'. The cathode of the diode $D_8$ is also connected via a resistor $R_{44}$ to the inverting input terminal of a voltage comparator $A_3$, a further resistor $R_{45}$ connecting this input terminal to the inverting input terminal of a further voltage comparator $A_4$. The non-inverting input terminals of the comparators $A_3$ and $A_4$ are connected to the common points of three resistors $R_{46}$, $R_{47}$ and $R_{48}$ connected in series between the rails 30 and 31 so that the non-inverting input terminal of the comparator $A_3$ is at a higher voltage than that of comparator $A_4$. Positive feedback resistors $R_{49}$, $R_{50}$ connect the output terminals of the two comparators $A_3$, $A_4$ to their non-inverting input terminals so as to provide a small amount of hysteresis to prevent spurious triggering of the comparator. The output terminal of the comparator $A_3$ is connected to the inverting input terminal of the comparator $A_4$ and a load resistor $R_{51}$ is connected between the rail 30 and the output terminal of the comparator $A_4$ which is connected to the terminal D.

The voltage at the terminal C falls substantially linearly over the normal working range of the system. At low temperatures (e.g. below 15° C.) the output of the comparator $A_3$ is low and that of the comparator $A_4$ is therefore high. As the temperature rises and the voltage at terminal C falls, the comparator $A_3$ switches so that the output of the comparator $A_4$ goes low. As the temperature continues to rise the comparator $A_4$ switches (at about 60° C.) and its output goes high again.

Figure 4:
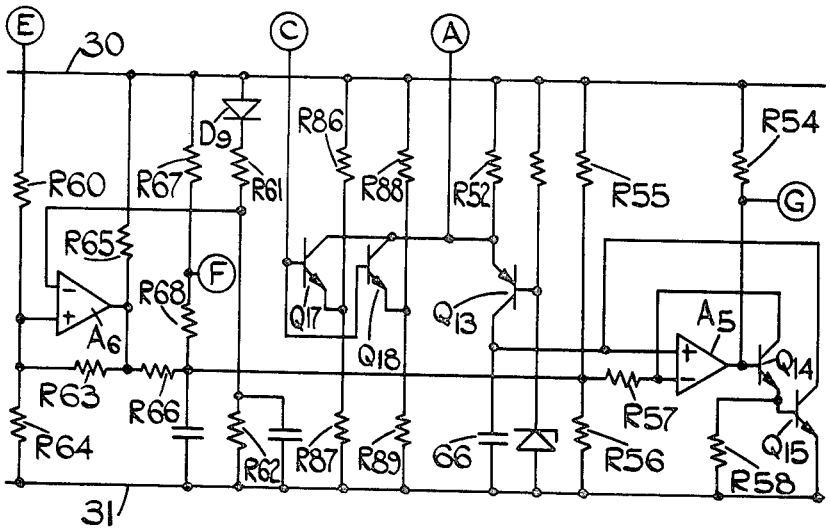
FIG. 4 is the circuit diagram of a clock pulse generator forming part of the control of FIG. 1.

Turning now to FIG. 4, the clock pulse generator includes a pnp transistor $Q_{13}$ with its base at a fixed voltage (of about 3.3 V) and its collector connected by a capacitor $C_6$ to the rail 31. The emitter of the transistor $Q_{13}$ is connected by a resistor $R_{52}$ to the rail 30 and is also connected to the terminal A. The terminal C of FIG. 3 is also arranged to provide an input to the clock circuit to vary the proportion of the current in resistor $R_{52}$ which enters the emitter of the transistor $Q_{13}$. The terminal C is connected to the base of two npn transistors $Q_{17}$ and $Q_{18}$ which have their collectors connected to the emitter of the transistor $Q_{13}$. The emitter of the transistor $Q_{17}$ is connected to the common point of two resistors $R_{86}$ and $R_{87}$ connected in series between the rails 30, 31. Similarly the emitter of the transistor $Q_{15}$ is connected to the common point of two resistors $R_{88}$, $R_{89}$ connected in series between the rails 30, 31. The resistors $R_{86}$ to $R_{89}$ are chosen so that the transistor's $Q_{17}$, $Q_{18}$ switch off at different voltage levels of terminal C. Thus the current drawn by the transistors $Q_{17}$, $Q_{18}$ will decrease with increasing temperature, initially at a relatively steep slope until the transistor $Q_{17}$ turns off and then at a shallow slope until transistor $Q_{18}$ turns off. At higher temperatures the current drawn through the resistor $R_{52}$ is not temperature dependent. The collector of the transistor $Q_{13}$ is connected to the non-inverting input terminal of a comparator $A_5$ which has a load resistor $R_{54}$ connected between its output terminal and the rail 30. The inverting input terminal of the comparator $A_5$ is connected by a resistor to the common point of two resistors $R_{55}$, $R_{56}$ connected in series between the rails 30 and 31. The output terminal of the comparator $A_5$ is connected to the base of an npn transistor $Q_{14}$ the emitter of which is connected by a resistor $R_{58}$ to the rail 31 and the collector of which is connected to the inverting input terminal of the comparator $A_5$. A second non transistor $Q_{15}$ has its base connected to the emitter of the transistor $Q_{14}$, its emitter grounded to the rail 31 and its collector connected to the non-inverting input terminal of the comparator $A_5$. Because of the fixed voltage bias on the base of the transistor $Q_{13}$ its emitter is held at a fixed voltage (about 4 V) and the current passing through the resistor $R_{52}$ is constant. A very small amount of this current passes through the base-emitter junction of the transistor $Q_{13}$ and variable amounts are sunk via the terminal A and via the transistors $Q_{17}$ and $Q_{18}$ depending on the conditions in the FIG. 1 circuit and the temperature respectively. The remaining current passes into the capacitor $C_6$ charging it linearly whenever the transistor $Q_{15}$ is off. This occurs whenever the output of the comparator $A_5$ is low so that the voltage at the non-inverting input terminal of the comparator rises linearly until it exceeds the voltage set at the inverting input terminal. The output of the comparator $A_5$ now goes high turning on both transistors $Q_{14}$ and $Q_{15}$. The transistors $Q_{14}$ causes the voltage at the inverting input terminal to be reduced by drawing current through the resistors $R_{55}$ and $R_{57}$, thereby increasing the speed of switching and the transistor $Q_{15}$ discharges the capacitor $C_6$, rapidly. The comparator $A_5$ then switches back to its original state and the cycle re-starts. For a fixed voltage at the junction of the resistors $R_{55}$, $R_{56}$ the frequency of the clock is proportional to the capacitor $C_6$ charging current.

The voltage at the junction of resistors $R_{55}$ and $R_{56}$ is not, however constant because of the effect of the components shown at the left hand side of FIG. 4. These components include a voltage comparator $A_6$ which has its non-inverting input terminal connected by a resistor $R_{60}$ to the terminal E (of FIG. 2) and its inverting input terminal connected to the common point of two resistors $R_{61}$, $R_{62}$ connected in series between the rail 31 and the cathode of a diode $D_9$ the anode of which is connected to the rail 30. The comparator $A_6$ has positive feedback from its output terminal to its non-inverting input terminal via a resistor $R_{63}$ and a further resistor $R_{64}$ connects the non-inverting input terminal to the rail 31. A resistor $R_{65}$ connects the output terminal of the comparator $A_6$ to the rail 30 and a resistor $R_{66}$ connects this output terminal to the junction of the resistors $R_{55}$ and $R_{56}$.

The comparator $A_6$ is set so that its output is normally low but goes high when the accelerator pedal is nearly fully depressed. This causes an increase in the voltage at the junction of the resistors $R_{55}$ and $R_{56}$ and therefore decreases the clock frequency and increases the quantity of fuel injected for a given fuel demand signal.

In addition two resistors $R_{67}$ and $R_{68}$ are connected in series between the rail 30 and the junction of the resistors $R_{55}$ and $R_{56}$. These normally increase the voltage at the junction of $R_{55}$ and $R_{56}$ slightly, but a terminal F at the junction of the resistors $R_{67}$ and $R_{68}$ is provided and can be grounded whenever it is intended that the vehicle in which the fuel injection control is installed is to be used predominatly at high attitudes. This increases the clock frequency and reduces the fuel injected.

Figure 9:
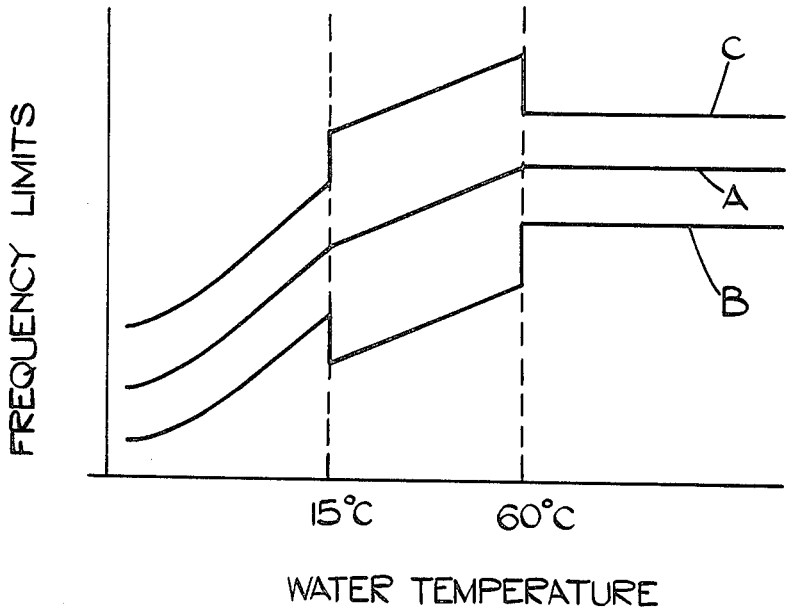
FIG. 9 is a graph illustrating the relationship between the clock pulse generator output frequency and the engine water temperature achieved in the example of the invention shown in FIGS. 1 to 4.

Turning now to FIG. 9, the graph shows the overall effect of temperature on the clock frequency. The line A is the steady state frequency curve and the lines B and C show the limits of frequency variation resulting from clamping of the differentiating circuit in acceleration and deceleration respectively.

Below 15° C. and above 60° C. the transistor $Q_7$ is off because the output of the comparator $A_4$ which controls it is high. Relatively narrow limits of acceleration enrichment and deceleration enleanment are then permitted. In between 15° C. and 60° C. the output of the comparator $A_4$ goes low turning on the transistor $Q_7$ and the overall gain of the differentiator (considered as a current sink) increases.

Figure 5:
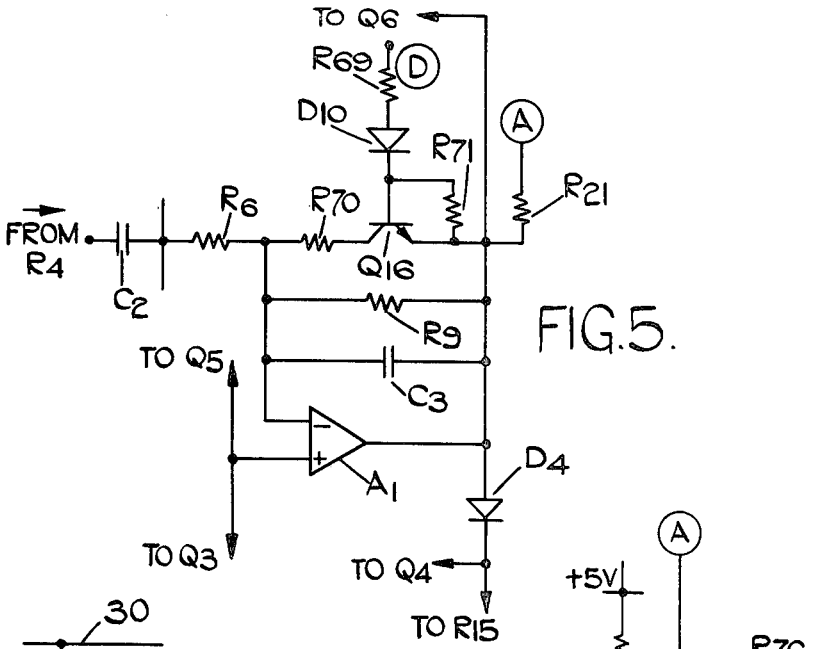
FIGS. 5, 6, 7 and 8 are fragmentary circuit diagrams illustrating four possible modifications to the circuit shown in FIG. 2.

In the modification shown in FIG. 5 gain variation with temperature is obtained by switching in and out an additional resistor $R_{70}$ in parallel with the resistor $R_9$. This is effected by means of an npn transistor $Q_{16}$ with its collector connected by the resistor $R_{70}$ to the inverting input terminal of the amplifier $A_1$ and its emitter connected to the output terminal of the amplifier $A_1$. A bias resistor $R_{71}$ is connected between the base and emitter of the transistor $Q_{16}$ to bias it off and a diode $D_{10}$ and a resistor $R_{69}$ in series connect the base of the transistor to the terminal D to turn the transistor $Q_{16}$ on at extreme temperatures and thereby reduce the gain of the differentiating circuit.

Figure 6:
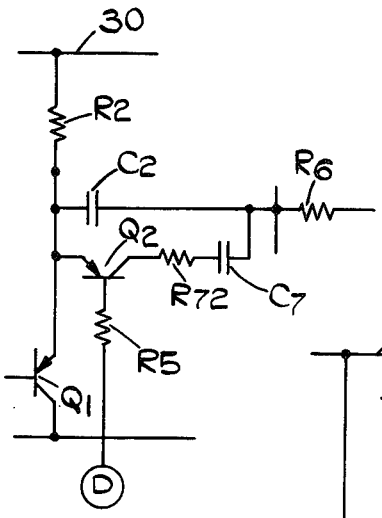

The modification shown in FIG. 6 affects the time law switch based on transistor $Q_2$. Instead of varying a resistance in series with the capacitor $C_2$, the transistor $Q_2$ now introduces a capacitor $C_7$ and resistor $R_{72}$ in series with one another across the capacitor $C_2$. This not only changes the time constants in the manner required but also varies the gain of the differentiator so that the transistor $Q_7$ of FIG. 2 can be omitted completely. The diode $D_2$ must also be emitted so that time law variations apply to acceleration and deceleration clamping.

Figure 7:
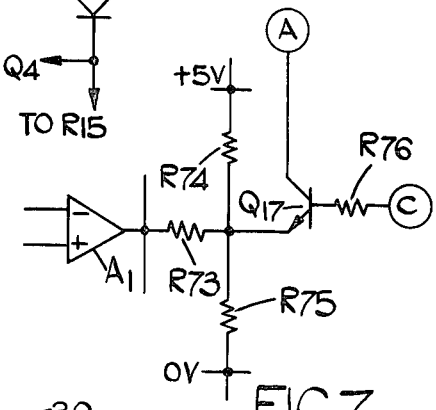

The modification shown in FIG. 7 includes a quite different form of arrangement for varying the effect of the differentiation on the clock frequency with temperature. In this case the output of the amplifier $A_1$ is connected by a resistor $R_{73}$ to the common point of a pair of resistors $R_{74}$ and $R_{75}$ connected in series between the rails 30 and 31. The emitter of a transistor $Q_{17}$ is connected to this same common point, the collector of this transistor being connected to the terminal A and its base being connected by a resistor $R_{76}$ to the terminal C. This modification can be used in conjunction with the modifications shown in FIGS. 5 and 6 which give gain variation by alteration of feedback or by alteration of the input capacitance of the differentiating circuit.

Figure 8:
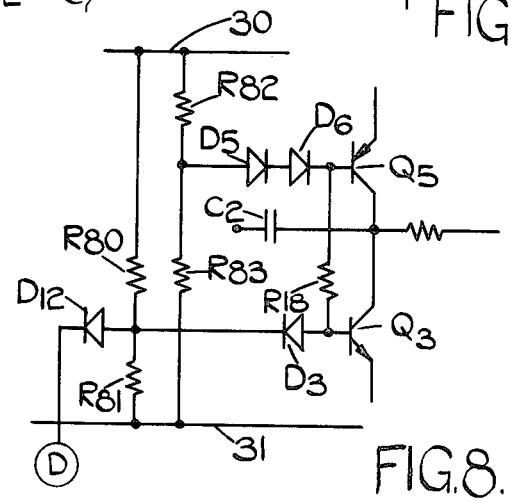

Turning finally to FIG. 8 a different arrangement is shown for determining the clamping threshold levels. In this case separate potential dividers are used for biasing the acceleration and deceleration clamp circuits. The resistors $R_{80}$ and $R_{81}$ connected in series between the rails 30 and 31 have their common point connected to the cathode of the diode $D_3$. Two further resistors $R_{82}$ and $R_{83}$ connected in series between the rails 30, 31 have their common point connected to the anode of the diode $D_5$. The terminal D is connected to the cathode of a diode $D_{12}$ with its anode connected to the common point of the resistors $R_{80}$ and $R_{81}$ so that only the acceleration clamping threshold is altered when the signal at D goes low.

Figure 10:
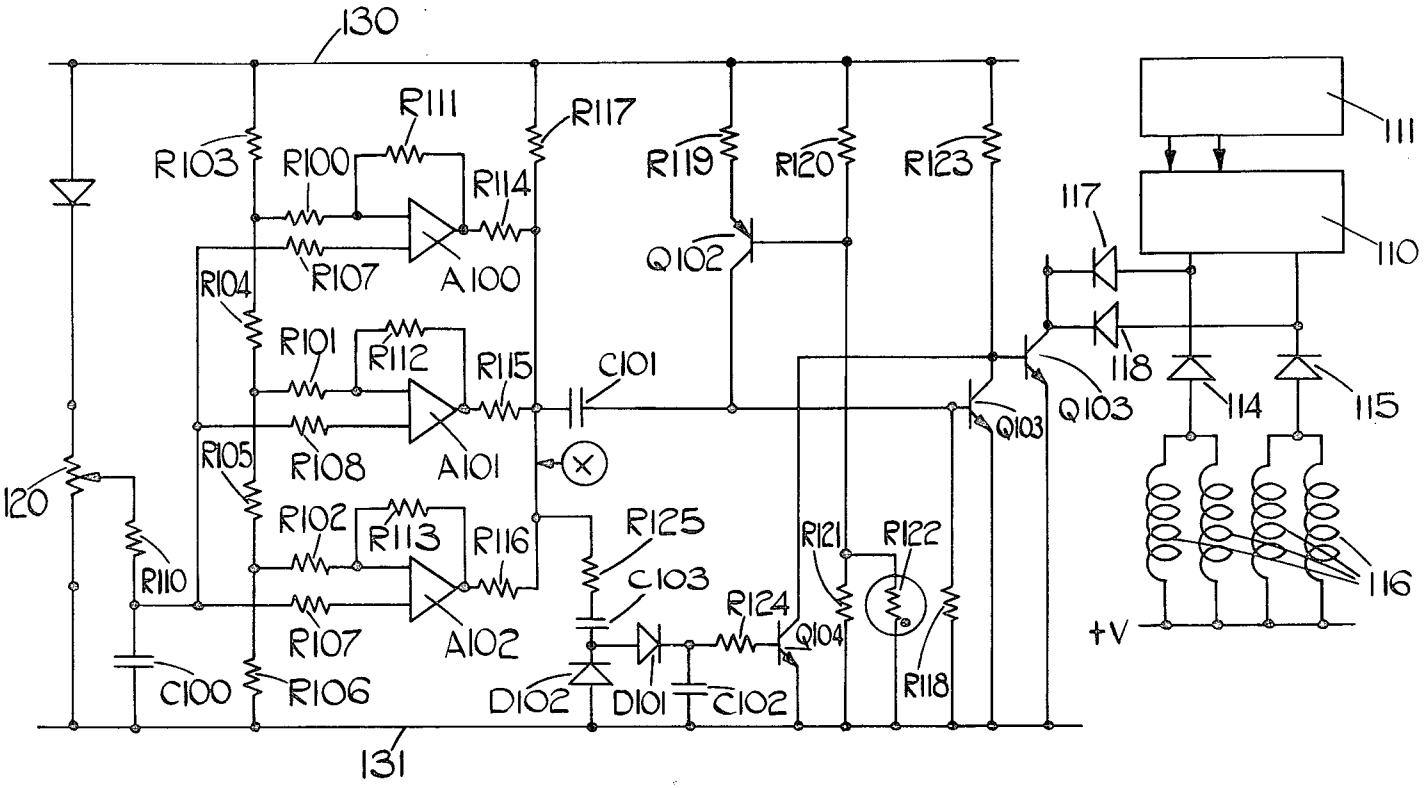
FIG. 10 is a circuit diagram illustrating another example of an electronic fuel injection control in accordance with the invention.

Turning now to FIG. 10 the invention is applied to a system which does not use the acceleration enrichment/deceleration enleanment of the example shown in FIGS. 1 to 4. Instead, an "extra pulse" circuit and corresponding muting circuit are used with an otherwise conventional system.

The main fuel control 110 controls the pulse lengths applied to injectors 116 (via diodes 114, 115) in accordance with signals from one or more engine parameter transducers 111. Diodes 117, 118 connect the solenoids to the "extra pulse" circuit.

This circuit includes an array of voltage comparators $A_{100}$, $A_{101}$ and $A_{102}$ which have their non-inverting input terminals connected by resistors $R_{100}$, $R_{101}$ and $R_{102}$ to different voltage points on a potential divider chain consisting of resistors $R_{103}$, $R_{104}$, $R_{105}$ and $R_{106}$ connected in series between a positive supply rail 130 and a ground rail 131. The inverting input terminals of the comparators $A_{100}$, $A_{101}$, and $A_{102}$ are connected by resistors $R_{107}$, $R_{108}$, and $R_{109}$ to one side of a capacitor $C_{100}$ the other side of which is grounded. Said one side of the capacitor $C_{100}$ is connected by a resistor $R_{110}$ to a potentiometer 120 operated by the accelerator pedal for the engine. Each comparator has positive feedback resistor $R_{111}$, $R_{112}$, $R_{113}$ to provide some hysteresis. Such hysteresis, used in combination with the filtering provided by the resistor $R_{110}$ and the capacitor $C_{100}$, prevents spurious triggering of the comparators $A_{100}$, $A_{101}$ and $A_{102}$ by noise and interference.

The output terminals of the comparators $A_{100}$, $A_{101}$ and $A_{102}$ are connected by resistors $R_{114}$, $R_{115}$, $R_{116}$ to a common point X which is connected by a resistor $R_{117}$ to the rail 130 (the comparators being of the open collector type). A capacitor $C_{101}$ couples to the point X to the base of an npn transistor $Q_{101}$ which base is also connected by a resistor $R_{118}$ to the rail 131.

A pnp transistor $Q_{102}$ is connected to act as a current source to provide current for charging the capacitor $C_{101}$. The emitter of the transistor $Q_{102}$ is connected by a resistor $R_{119}$ to the rail 130 and its base is connected to the common point of two resistors $R_{120}$, $R_{121}$ connected in series between the rails 130, 131, a thermistor $R_{122}$ (sensitive to engine water temperature) being connected in parallel with the resistor $R_{121}$. The collector of the transistor $Q_{102}$ is connected to the base of the transistor $Q_{101}$.

The collector of the transistor $Q_{101}$ is connected to the base of an npn output transistor $Q_{103}$ and also, by a resistor $R_{123}$ to the rail 130, both transistors $Q_{101}$ and $Q_{103}$ have their emitters connected to the rail 131 and the collector of the transistor $Q_{103}$ is connected to the cathodes of the diodes 117, 118.

In use the comparators $A_{100}$, $A_{101}$ and $A_{102}$ are switched sequentially as the slider of the potentiometer 120 is moved away from the grounded end of the potentiometer. Switching occur at three specific positions of the slider and each switching operation reduces the voltage at the point X. Transistor $Q_{101}$ is normally held on by the current from transistor $Q_{102}$ passing through the resistor $R_{118}$ and the base-emitter of the transistor $Q_{101}$. When the voltage at the point X falls, however the current from the transistor $Q_{102}$ is diverted to charge the capacitor $C_{101}$ and the transistor $Q_{101}$ turns off for time dependent on the charge in voltage at the point X and the current from transistor $Q_{102}$ (which varies with engine temperature). Transistor $Q_{103}$ is turned on for this same duration and causes extra pulses to be applied to the injector 116 in addition to the normal pulse duration modulated pulses from the main control circuit 10.

For muting the extra pulses immediately after deceleration, an npn transistor $Q_{104}$ is provided with its emitter connected to the rail 131 and its collector connected to the base of the transistor $Q_{101}$. The base of the transistor $Q_{104}$ is connected by a resistor $R_{124}$ to the cathode of a diode $D_{101}$ which is also connected by a capacitor $C_{102}$ to the rail 131. The anode of the diode $D_{101}$ is connected to the cathode of a diode $D_{102}$ with its anode connected to the rail 131. The anode of the diode $D_{101}$ is also connected by a capacitor $C_{103}$ and a resistor $R_{125}$ in series to the point X. The capacitors $C_{102}$, $C_{103}$ and the diodes $D_{101}$ $D_{102}$ constitute a diode pump circuit.

During deceleration the voltage at the point X goes up at three positions of the slider of the potentiometer 120. After each such increase in voltage at the point X the transistor $Q_{104}$ is turned on for a period determined by the voltage which is transferred to the capacitor $C_{102}$ through the diode $D_{101}$ and by the base current of the transistor $Q_{104}$. While transistor $Q_{104}$ is on transistor $Q_{103}$ cannot turn on.

It will be appreciated that rapid movement of the slider of potentiometer 120 will result in the comparators switching at very short intervals. During acceleration the effect is to produce a single extended pulse of duration approximately equal to the sum of the durations of the three pulses produced by slow movement of the slider. Similarly, rapid movement of the slider in deceleration causes the muting signal from transistor $Q_{104}$ to be extended.

We claim:

1. An electronic fuel injection control for an internal combustion engine having an engine throttle, the control comprising a main fuel control circuit for applying to at least one fuel injection valve pulses of duration determined by at least one engine operating parameter controlling said main fuel control circuit, an auxiliary pulse source sensitive to opening movement of the engine throttle for applying at least one additional pulse to said fuel injection valve when the throttle is opening, and muting means sensitive to closing movement of the throttle and arranged to prevent the auxiliary pulse source from producing a pulse for a predetermined time following closing movement of the throttle, said auxiliary pulse source comprising means sensitive to the rate of change of the position of the throttle so as to produce a pulse whenever the rate of change exceeds a predetermined positive value, said muting means being connected to said rate of change sensitive means so as to be brought into operation when the rate of change is less than a predetermined negative value.

2. An electronic fuel injection control as claimed in claim 1 in which said rate of change sensitive means comprises a throttle position transducer producing an electrical signal dependent on the throttle position, and an operational amplifier differentiating circuit connected to said transducer.

3. An electronic fuel injection control as claimed in claim 2 in which said differentiating circuiit incorporates two clamping means for clamping the operational amplifier output to limit levels representing limiting acceleration level and limiting deceleration level respectively, said auxiliary pulse source being connected to be operated by one clamping means and the muting means being connected to be operated by the other clamping means.

4. An electronic fuel injection control for an internal combustion engine having an engine throttle, the control comprising a main fuel control circuit for applying to at least one fuel injection valve pulses of duration determined by at least one engine operating parameter controlling said main fuel control circuit, an auxiliary pulse source sensitive to opening movement of the engine throttle for applying at least one additional pulse to said fuel injection valve when the throttle is opening, and muting means sensitive to closing movement of the throttle and arranged to prevent the auxiliary pulse source from producing a pulse for a predetermined time following closing movement of the throttle, said axuiliary pulse source comprising a plurality of comparators connected to compare the output of a throttle position transducer with a plurality of reference signals, the auxiliary pulse source producing pulses when the throttle is moved in throttle opening direction through positions corresponding to said reference signals, said muting means being brought into operation when the throttle is moved in throttle closing diirection through positions corresponding to said reference signals.

5. An electronic fuel injection control as claimed in claim 4 in which said auxiliary pulse source comprises a transistor switching circuit, a current source connected to said switching circuit to provide bias current thereto, a resistor network interconnecting the outputs of said comparators and a capacitor coupling said resistor network to the switching circuit so as to divert the bias current into the capacitor for a period following each switching action of each comparator during opening movement of the throttle.

6. An electronic fuel injection control as claimed in claim 5 in which said muting means comprises a diode pump circuit connected to said resistor network and a transistor controlled by said diode pump circuit for disabling said switching circuit.

* * * * *